United States Patent [19]

Paulucci

[11] 4,361,227

[45] Nov. 30, 1982

[54] DISPLAY PACKAGE

[75] Inventor: Jeno F. Paulucci, Duluth, Minn.

[73] Assignee: Jeno's, Inc., Duluth, Minn.

[21] Appl. No.: 260,414

[22] Filed: May 4, 1981

Related U.S. Application Data

[63] Continuation-in-part of Ser. No. 221,400, Dec. 30, 1980, abandoned, which is a continuation of Ser. No. 80,930, Oct. 1, 1979, abandoned.

[51] Int. Cl.[3] ..... B65D 65/16

[52] U.S. Cl. ..... 206/45.32; 206/45.33; 206/497; 426/120; 426/124; 426/128

[58] Field of Search ..... 206/45.32, 45.34, 45.33, 206/497, 219, 220, 222; 426/128, 124, 120

[56] References Cited

U.S. PATENT DOCUMENTS

| | | | |
|---|---|---|---|
| 2,236,641 | 4/1941 | Karmen | 426/120 |
| 2,404,776 | 7/1946 | Ehrlich | 206/45.32 |
| 2,969,292 | 1/1961 | Heller | 426/124 |
| 3,026,209 | 3/1962 | Niblack et al. | 206/45.33 |
| 3,149,943 | 9/1964 | Amador | 206/219 |
| 3,176,836 | 4/1965 | Gunn | 206/45.33 |
| 3,573,069 | 3/1971 | Keller et al. | 206/219 |
| 3,650,383 | 3/1972 | Nigro | 426/128 |
| 3,681,092 | 8/1972 | Titchenal et al. | 206/45.33 |
| 3,861,576 | 1/1975 | Tolaas et al. | 426/128 |
| 4,125,633 | 11/1978 | Vanderlugt, Jr. | 426/124 |

FOREIGN PATENT DOCUMENTS

| | | | |
|---|---|---|---|
| 232860 | 4/1925 | United Kingdom | 206/45.33 |

OTHER PUBLICATIONS

Publication from Ekco Foil Container Corporation, 1965.

*Primary Examiner*—Joseph Man-Fu Moy
*Attorney, Agent, or Firm*—Hume, Clement, Brinks, Willian & Olds, Ltd.

[57] ABSTRACT

A display package comprising a semi-rigid outer container having a front wall and a back wall with a cutout creating an opening in the front wall. The outer container encloses an inner container, the latter comprising a sheet or pouch of film plastic on a food product base, a plurality of intermediate pouches loosely enclosing separate food product ingredients, and an outer pouch of shrink film plastic heat shrunk onto the base over the intermediate pouches so as to hold them in place. The film forms a window for viewing the food products through the cutout.

3 Claims, 9 Drawing Figures

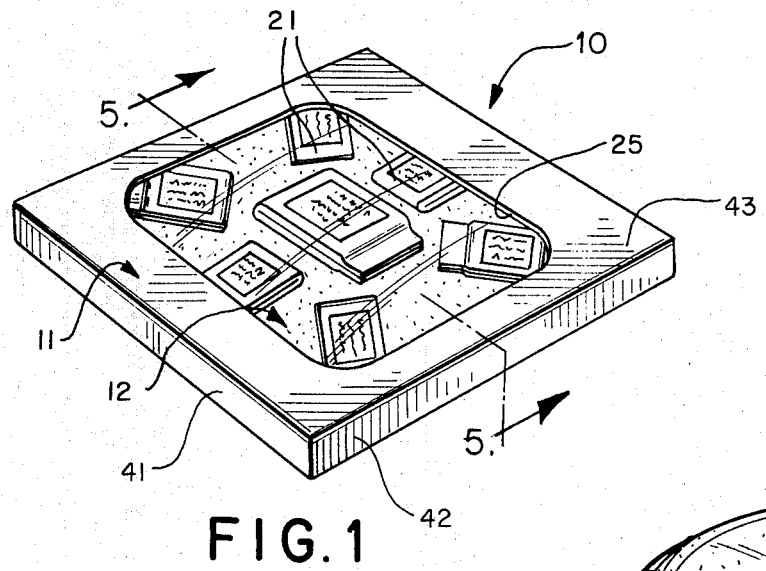
FIG. 1
FIG. 2
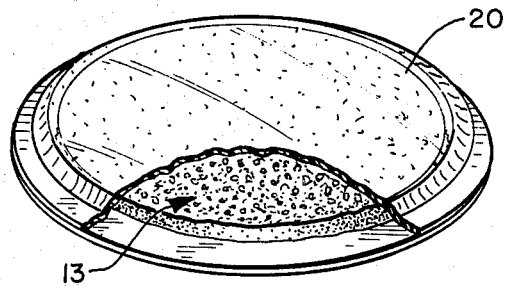
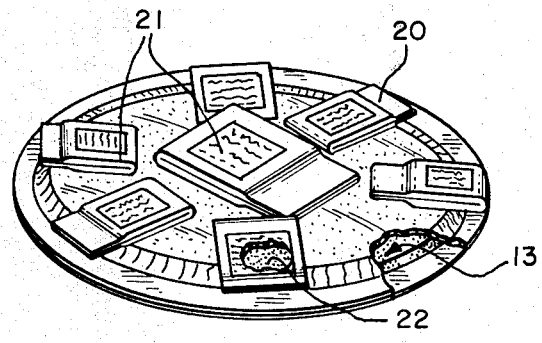
FIG. 3
FIG. 4
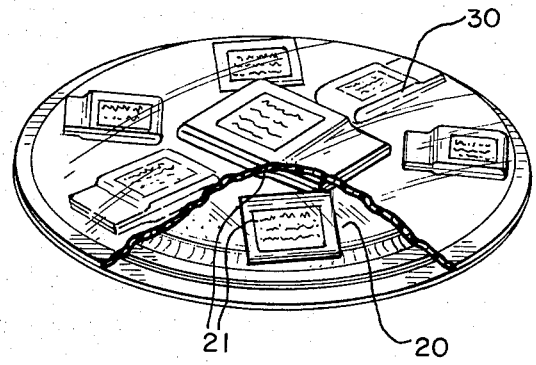
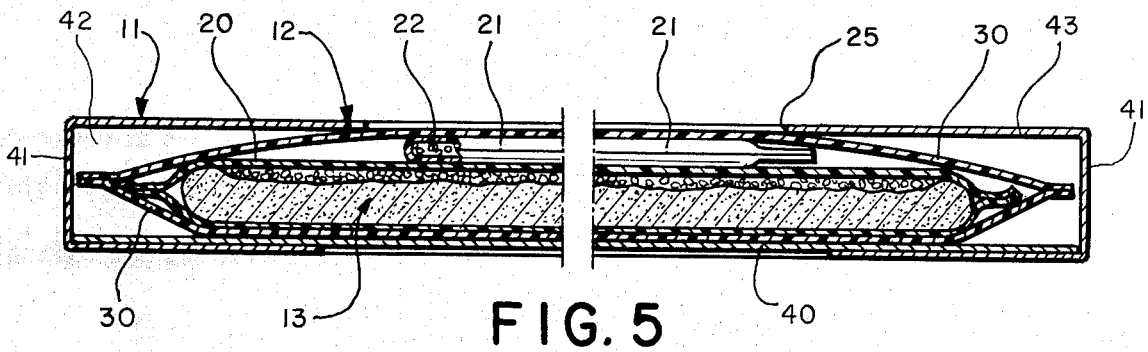
FIG. 5

FIG. 6
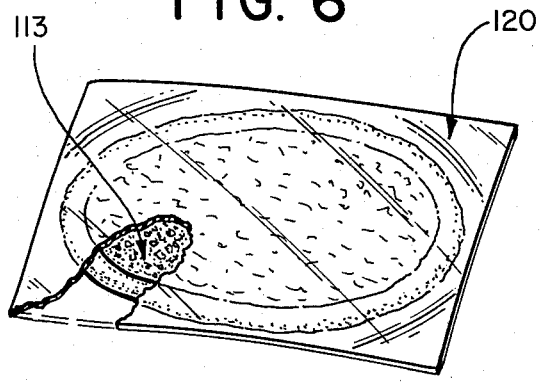
FIG. 7
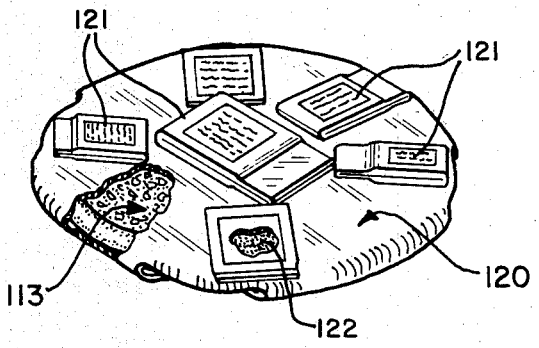
FIG. 8
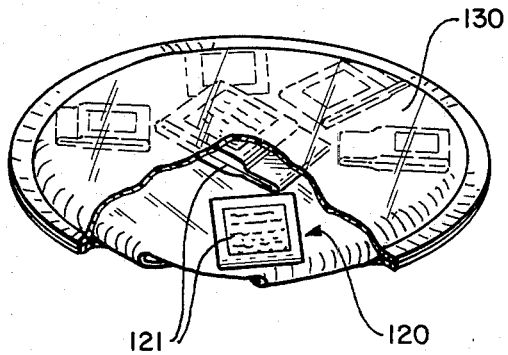
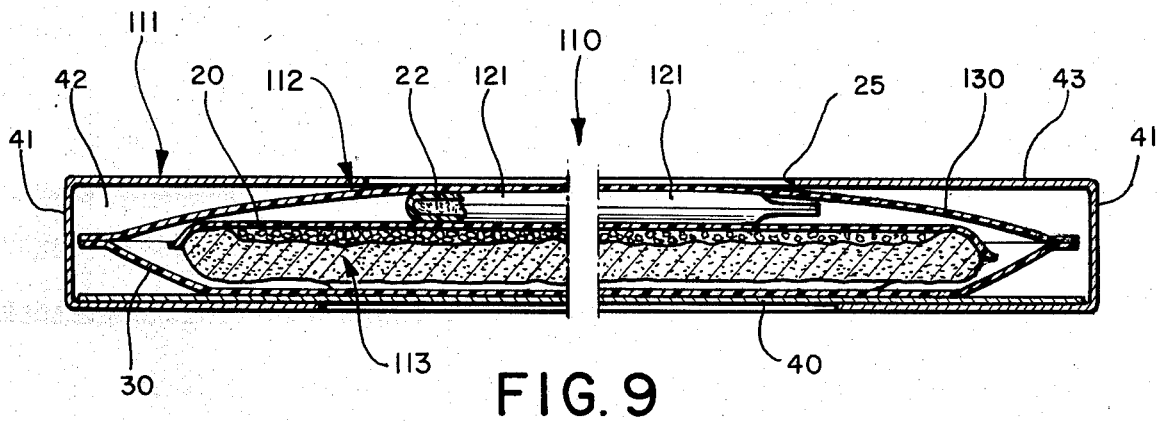
FIG. 9

DISPLAY PACKAGE

RELATED APPLICATIONS

This application is a continuation-in-part of application Ser. No. 221,400, filed Dec. 30, 1980. The letter was a continuation of application Ser. No. 80,930, filed Oct. 1, 1979 now all abandoned.

TECHNICAL FIELD

This invention is in the field of packaging. It relates generally to display packaging for food products.

BACKGROUND OF THE INVENTION

Display packaging is designed to show the prospective purchaser what he or she is getting while, at the same time, the packaging adequately protects the product. Such packaging is widely used on many products, including foods. Where a single non-exotic product is involved the packaging is simple and conventional.

With food products it is conventional to provide a box container having a front "window". The food product is packaged behind the window, visible but separated from the environment by a plastic window 37 pane", for example.

DISCLOSURE OF THE INVENTION

The present invention is embodied in a new and improved display package for a food product. It is an object of the invention to provide such a display package for multiple ingredient frozen food products. It is another object to provide a display package for multiple ingredient frozen food products which are marketed in semi-completed form. It is still another object to provide a display package which displays a multiple ingredient frozen food product in such a manner that all of the ingredients are retained in highly visible relationship while being sealed off from each other and from the environment yet packaged in a compact and easily handleable form.

The foregoing and other objects are realized in accordance with the present invention by providing an outer container fabricated of packaging paperboard or corrugated material which is semi-rigid. The outer container has a front wall and a back wall, with a cutout creating an opening in the front wall. Inside the outer container is disposed an inner container.

In a first embodiment the inner container includes an inner pouch and a plurality of intermediate pouches. The inner pouch consists of a heat shrink plastic film material which is shrunk onto the food product so as to fit the food product snugly. Each of the intermediate pouches consists of a plastic film material which separately encloses one of the ingredients but which does so loosely since it is not shrink film material. The intermediate pouches are positioned on the inner pouch in such a manner that they will be visible through the cutout in the outer container when the inner container with its food product contents is put in the outer container. In this sense the intermediate pouches are separately placed against the outer surface of the inner pouch immediately adjacent each other.

Both the inner pouch and the intermediate pouches are then enclosed by an outer pouch, also consisting of a heat shrink film material, which is heat shrunk onto the food product over the inner pouch and the intermediate pouches. The plastic film encased food product base and separate ingredient pouches are then positioned in the inner container with the intermediate pouches all visible through the cutout opening in the outer container. The film and the cutout create a window for product viewing.

In a second embodiment the inner pouch is replaced by a sheet of plastic film overlying the food product but not enclosing it. The intermediate pouches are placed on top of the sheet of film. The outer pouch is then shrunk onto the food product over the inner sheet and the intermediate pouches.

BRIEF DESCRIPTION OF THE DRAWINGS

FIG. 1 is a perspective view of a display package for a multiple ingredient frozen food product embodying features of the invention;

FIG. 2 is a perspective view of a food product base, in this case frozen, partially baked pizza dough with a top covering of cheese, tomato sauce, and sausage, having an inner pouch consisting of a shrink film material heat shrunk onto the food product base so as to fit it snugly;

FIG. 3 is a perspective view of the plastic encased food product base of FIG. 2, with individual ingredient intermediate pouches of plastic film disposed outside of and on one side of the plastic encased food product base;

FIG. 4 is a perspective view, similar to FIG. 3, with the intermediate pouches and the inner pouch being enclosed by an outer pouch consisting of a shrink film material which is heat shrunk onto the food product base over the inner pouch and the intermediate pouches, all positioned as illustrated in FIG. 3;

FIG. 5 is a sectional view taken along line 5—5 of FIG. 1;

FIG. 6 is a perspective view of a frozen food product base similar to that illustrated in FIG. 2, having a square sheet of plastic film material overlying the food product base so as to cover it completely;

FIG. 7 is a perspective view of the plastic film covered food product base of FIG. 6, with individual ingredient intermediate pouches of plastic film disposed outside of and on one side of the plastic sheet covered food product base;

FIG. 8 is a perspective view, similar to FIG. 7, with the intermediate pouches and the plastic film sheet underneath them being enclosed by an outer pouch consisting of a shrink film material which is heat shrunk onto the food product base over both the intermediate pouches and the sheet of film on which they rest, all positioned as illustrated in FIG. 7; and FIG. 9 is a sectional view, similar to FIG. 5, illustrating a second form of the display package embodying features of the invention.

DESCRIPTION OF THE PREFERRED EMBODIMENT

Referring now to the drawing, and particularly to FIG. 1, a display package for a multiple ingredient frozen food product embodying features of the present invention is illustrated generally at 10. The display package 10 comprises an outer container 11 fabricated of semi-rigid paperboard or corrugated material and an inner container 12 fabricated of plastic film and encasing the multiple ingredient food product in a manner hereinafter discussed.

In order to more readily understand the construction and arrangement of the display package 10 its assembly with the food product 13 is described in stages. The food product 13 of interest here is frozen pizza.

The frozen pizza 13 incorporating only the partially cooked basic dough with a cheese, tomato sauce, and sausage covering is first packaged in the inner container 12. As seen in FIG. 2 the inner container 12 comprises an inner pouch 20 consisting of a plastic heat shrink film material. The inner pouch 20 is initially formed in a bag-like configuration large enough to receive the entire frozen pizza base 13. It has a plurality of holes punched in it. The inner pouch 20 is "shrunk" onto the food product base by conventional shrink film techniques so as to enclose the food product base without entrapping air.

As seen in FIG. 3 a plurality of intermediate pouches 21 are then provided for various different topping ingredients 22; pepperoni, red and green peppers, olives, onions, herbs, cheese, and mushrooms, for example. Of these ingredients 22 the onions and peppers are in their raw form while the pepperoni, olives, and mushrooms are cooked. The precise amount of each necessary for topping a pizza before it is baked by the purchaser is sealed in airtight relationship in corresponding containers and placed in a circular pattern on one side of the inner pouch 20 partially within the boundary of the window 25 in the outer container 11.

The inner container 12 also includes an outer pouch 30 made up of a plastic heat shrink film material; for example, a co-polymer olefin. This pouch 30 also has a plurality of holes punched in it. As seen in FIG. 4 the outer pouch 30 is, before shrinking, slipped over the inner pouch 20 with the intermediate pouches 21 positioned as hereinbefore described. The outer pouch 30 is then "shrunk" onto the inner pouch 20 and intermediate pouches 21 by conventional shrink film techniques so as to fix the intermediate pouches firmly in place where they were positioned.

The inner pouch 20, intermediate pouches 21, and outer pouch 30, assembled in the aforedescribed manner, comprise the inner container 12. The inner container 12 is then positioned within the outer container 11 in the manner illustrated in FIGS. 1 and 5.

The outer container 11 fabricated of cardboard includes a solid back panel 40, perpendicular side panels 41, and end panels 42, and a front panel 43. The front panel 43 has the generally rectangular shaped window 25 formed therein, as illustrated.

The back and front panels 40 and 43 are large rectangles having width and height dimensions slightly larger than the diameter of the finished pizza. The side panels 41 and end panels 42 have a "depth" dimension slightly greater than the inner container 12 after packaging. The window 25 is generally rectangular and has height and width dimensions slightly less than the diameter of the pizza.

The outer pouch 30 film forms a window 25 "pane" in the front panel 43. It provides a protective covering in this way, transparent yet holding the intermediate pouches 21 partially within the boundaries of the window. The inner pouch 20 additionally protects the frozen pizza base and provides a platform for supporting the intermediate pouches 21.

Referring now to FIG. 9, a second form of display package embodying features of the present invention is illustrated in section at 110. The display package 110 comprises an outer container 111 fabricated of semi-rigid paperboard or corrugated material and an inner container 112 fabricated of plastic film and encasing the multiple ingredient food product in the manner hereinafter discussed. Once again, in order to more readily understand the construction and arrangement of the display package 110, the assembly with the food product 113 is described in stages. The food product 113 is again a frozen pizza.

The frozen pizza 113 is first packaged in the inner container 112. As seen in FIG. 6, the inner container 112 comprises an inner sheet of film 120, ten (10) inches square, overlying the entire frozen pizza base 113. In the present illustration the frozen pizza base 113 is for a standard ten (10) inch diameter frozen pizza.

Referring now to FIG. 7, a plurality of intermediate pouches 121 are then provided for the various different topping ingredients 122 hereinbefore discussed. A precise amount of each necessary topping ingredients is sealed in airtight relationship in corresponding pouches 121 and placed in a circular pattern on top of the film sheet 120.

The inner container 112 also includes an outer pouch 130 made up of a plastic, heat shrink film material. The pouch 130 has a plurality of holes punched in it. As seen in FIG. 8 the outer pouch 130 is, before shrinking, slipped over the inner film sheet 120 with the intermediate pouches 121 positioned as hereinbefore described. The outer pouch 130 is then "shrunk" onto the the inner film sheet 120 and the intermediate pouches 121 by conventional shrink film techniques.

The inner film sheet 120, the intermediate pouches 121, and outer pouch 130, assembled in the aforedescribed manner, comprise the inner container 112. The inner container 112 is positioned within the outer container 111 in the manner described with regard to positioning the inner container 12 in the outer container 11. The outer container 111 is fabricated in a manner identical to the container 11. As such corresponding reference numerals plus 100 digits are used to identify corresponding components.

I claim:

1. A display package for multiple ingredient frozen food products marketed in semi-completed form, comprising:

a. an outer container fabricated of semi-rigid material and having a front wall and a back wall;

b. a cut-out creating an opening in the front wall; and, c. an inner container within said outer container;

d. said inner container including an inner member, an outer pouch, and a plurality of intermediate pouches;

e. said inner member comprising a sheet of plastic film material which overlies a food product base;

f. said outer pouch consisting of a plastic shrink film material which is heat shrunk onto said food product base over said inner member;

g. each of said intermediate pouches consisting of a plastic film material and loosely enclosing a separate ingredient;

h. said intermediate pouches being enclosed by said outer pouch but separated from said food product base by said inner member;

i. said intermediate pouches being held in position by said outer pouch whereby they are visible through said cutout opening in said outer container and the plastic films form a window through which the food product base and ingredients are visible;

j. said outer pouch having a plurality of holes formed in it prior to being shrunk into place.

2. The display package of claim 1 further characterized in that:

a. said inner member comprises a sheet of plastic film which covers one side of said food product base completely.

3. The display package of claim 1 further characterized in that:

a. said inner member comprises an inner pouch of shrink film material which is heat shrunk onto said base;

b. said inner pouch having a plurality of holes formed in it prior to being shrunk into place.

* * * * *